United States Patent [19]

Davis

[11] Patent Number: 4,702,130

[45] Date of Patent: Oct. 27, 1987

[54] BOTTLE CAP REMOVER

[76] Inventor: Bobby V. Davis, P.O. Box 2057 Rathburn Rd., Wooster, Ohio 44691

[21] Appl. No.: 869,247

[22] Filed: Jun. 2, 1986

[51] Int. Cl.[4] ..... B67B 7/16

[52] U.S. Cl. ..... 81/3.56

[58] Field of Search ..... 81/3.56, 3.44, 3.4, 81/3.07

[56] References Cited

U.S. PATENT DOCUMENTS

| | | | |
|---|---|---|---|
| 1,690,982 | 11/1928 | Kossuth | 81/3.44 |
| 1,728,418 | 9/1929 | Litchfield | 81/3.44 |
| 1,736,519 | 11/1929 | Bucholtz | 81/3.56 |
| 2,548,634 | 4/1951 | Stump | 81/303 |
| 2,551,511 | 5/1951 | Talbot | 81/3.56 |
| 2,592,679 | 4/1952 | Gedde | 81/3.44 |
| 2,593,358 | 4/1952 | Sprich | 81/3.44 |
| 2,757,561 | 8/1956 | Larner | 81/3.44 |
| 4,327,607 | 5/1982 | Morris | 81/3.56 |

*Primary Examiner*—Roscoe V. Parker

*Attorney, Agent, or Firm*—Frease & Bishop

[57] ABSTRACT

A lever type crown seal bottle cap remover including a first lever and a second lever pivotally connected to one another, the first lever having a crown cap engaging member extending at right angles therefrom and the second lever having a curved flange engaging finger adapted to be inserted between the lower edge of the crown cap to effect removal of the crown cap from the bottle without distorting the flat top crown surface of the crown cap.

2 Claims, 5 Drawing Figures

BOTTLE CAP REMOVER

BACKGROUND OF THE INVENTION

1. Field of the Invention

The invention relates to bottle openers and more specifically to a pivoted level bottle cap remover particularly adapted to remove and retain after removal crown seal bottle caps, of the kind commonly used as sealing closures for beverage bottles.

2. Description of the Prior Art

Many types and styles of bottle cap openers for removing crown seal bottle caps of the type used to close narrow necked beverage obttles are known in the prior art. These devices have included the common lever type opener which is operated by the user holding the bottle in one hand. This opener includes a protruding tab that engages the bottom edge of the crimped flange of the cap and a relatively flat crown engaging portion extending outwardly above the tab which engages the cap crown whereby the cap may be pried off of the bottle.

Other types of bottle openers have been proposed which are of the pivoted lever type. These openers function in essentially the same manner as the lever type wherein one of the pivoted levers engages the underneath edge of the crimped flange of the bottle cap, and the other of the pivoted levers engages the crown or top surface of the bottle cap. The pivoted lever members are squeezed together and the cap is pried by the action of the squeezing of the levers to remove the bottle cap from the bottle.

Examples of such pivoted lever bottle cap openers are shown in U. S. Pats. Nos. 1,690,982; 2,548,634; 2,551,511; 2,592,679; 2,593,358; 2,757,561. Each of the bottle cap openers of these prior art constructions have several inherent disadvantages. First, they tend to distort or crease the top or crown of the cap during the cap removal operation. Thus, it is extremely inconvenient and in some cases impossible to recap a bottle by using the cap that has been removed because the cap has been creased or distorted during removal. Such recapping is frequently desirable when the contents of the bottle are only partially used and it is desired to save the unused contents for later usage.

Secondly, all of these devices operate in positions that are at right angles as to the axis of the bottle. This requires a somewhat awkward and inconvenient orientation of the hands of the person opening the bottle during the bottle opening procedure.

Additionally, it is desirable that upon removal of the cap from the bottle that it be retained in a positive manner by the opener and at the same time not distort the removed cap shape in the crown area thereof.

Accordingly, there is a need for an easily used convenient bottle cap opener for removing crown seal bottle caps from bottles which will permit operation with the hands of the user in natural oriented opposed fashion, and which will positively grip the removed cap without distorting the crown of the cap.

SUMMARY OF THE INVENTION

Objectives of the invention include the provision of a lever type crown seal bottle cap remover in which the remover is operated with the hands of the user in normally opposed position to one another rather than at angles to each other, in which the opener engages the bottle cap in a manner so that the top surface of the cap crown from which a crimped flange extends is not distorted during bottle cap opening, in which a portion of the opener extends and projects during opening into the space between the top ring or bead of the bottle and the downwardly extending flange to deflect away from the bottle top during opening a portion of the flange while at the same time positively retaining the bottle cap after its removal in cooperation with a top engaging member, and in which the removal procedure is effected by squeezing by a person opening the bottle of two levers toward one another, which levers are oriented either parallel to or at an acute angle with the axis of the bottle.

These and other objectives and advantages may be obtained by the improved bottle cap removal construction of the present invention, the general nature of which may be stated as including a first lever and second lever pivotally connected to one another, said first lever having a cap crown engaging member extending at right angles therefrom and the second lever having a curved flange engaging finger extending therefrom and movable in response to pivoting of the levers toward the top engaging member, said curved flange engaging finger being formed to conform in shape with the annular ring or bead of the bottle on which the bottle cap is sealed, and adapted to be inserted between the lower edge of the crimped flange of the bottle cap and the bottle cap neck.

BRIEF DESCRIPTION OF THE DRAWING

An improved embodiment of the invention, illustrative of the best mode in which applicant has contemplated applying the principles, is set forth in the following description and shown in the drawing andis distinctly pointed out and set forth in the appended claims.

In the drawing.

Similar numerals refer to similar parts throughout the drawing.

DESCRIPTION OF THE PREFERRED EMBODIMENT

Figure 4:
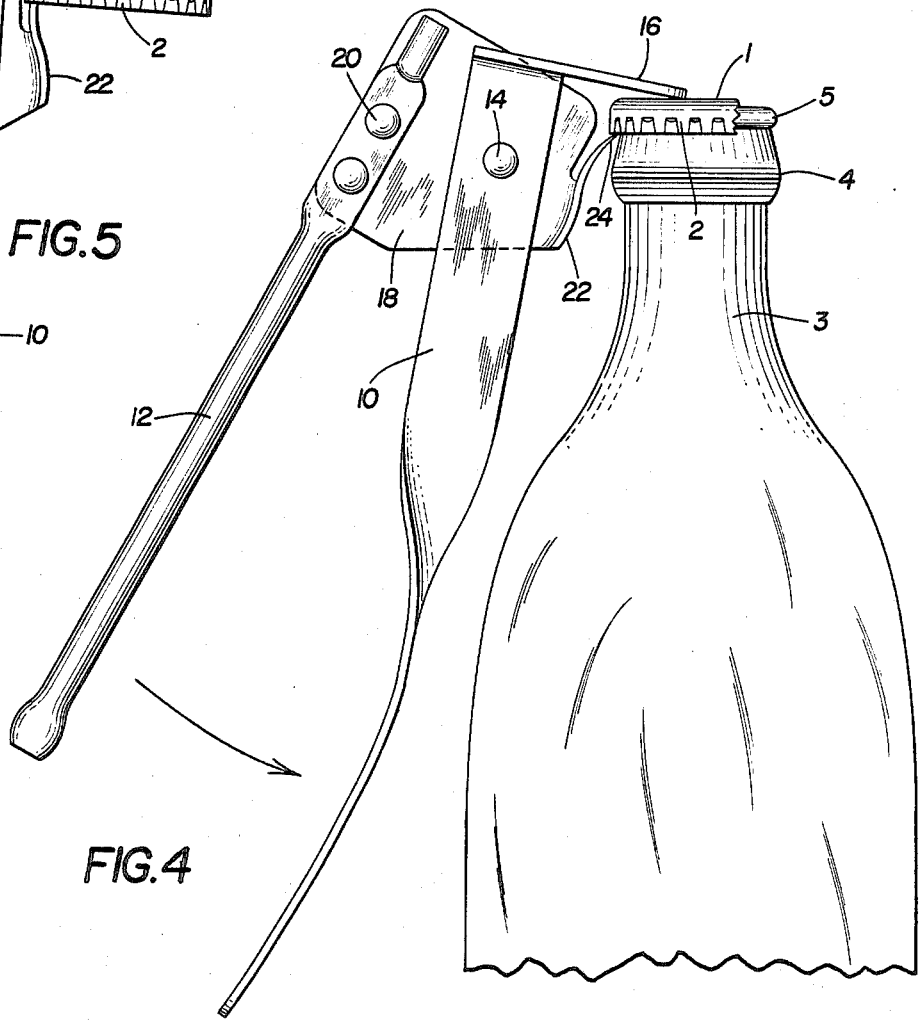
FIG. 4 is a side elevation illustrating the manner in which the bottle cap opener of the present invention initially engages the bottle cap prior to removal from a bottle.

Referring to the drawings, and specifically to FIG. 4, crown seal bottle caps generally include a top or crown 1 of circular shape and a downwardly extending crimped flange 2. The neck 3 of the bottle upon which the cap is mounted or sealed includes a first bead 4 of annular shape and a second bead 5 located above bead 4 upon which a crimped flange 2 of the cap is frictionally mounted. The inner or bottle engaging surface of crown 1 normally includes a seal or cork or plastic which is held in tight engagement with the top bead 5 of the bottle when the bottle cap is sealed.

The bottle cap remover of the present invention includes a first lever handle 10 and second lever handle 12 which are pivotally mounted at 14 with respect to each other, and both handle members 10 and 12 are generally elongated in shape.

Handle 10 includes at its outer end a crown engaging jaw member 16 which is generally flat and extends generally perpendicularly from the elongated axis of the handle 10. Handle 12 is mounted to a mounting plate 18 by suitable fastening means 20 and includes a portion for receiving pivot 14 to thereby connect levers 10 and 12 in pivoting relationship to one another. Mounting plate 18, which is a part of lever 12, includes a curved finger 22 which is adapted to conform generally in shape to the annular bead 4 of the bottle with which it is to be used. Finger 22 terminates in a sharp flange engaging portion 24 that is adapted to be inserted between the downwardly projecting crimped flange 2 of a bottle cap and the annular rings 4 and 5 of bottle neck 3.

Figure 1:
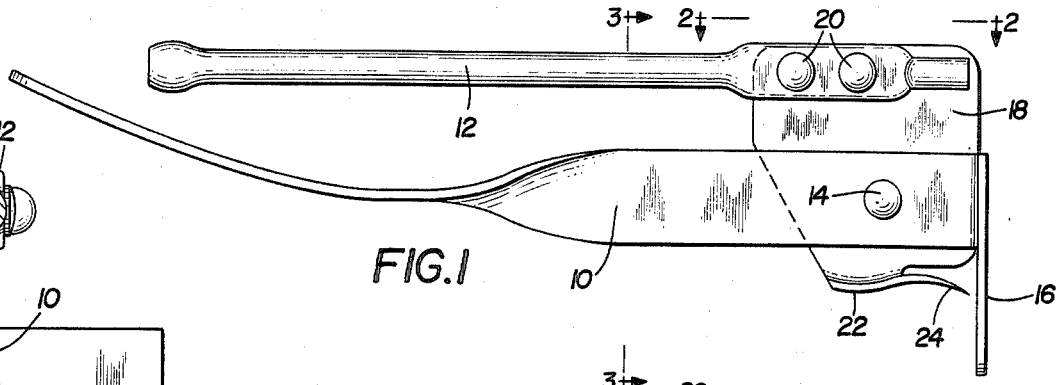
FIG. 1 is a side elevation of the bottle cap construction of the present invention.
Figure 3:
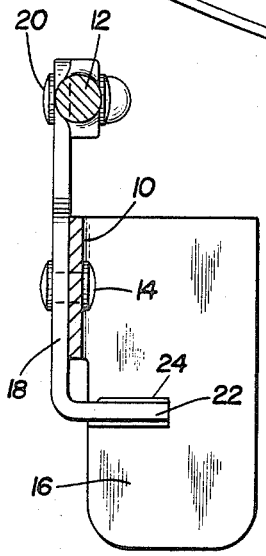
FIG. 3 is a vertical section taken on line 3—3 of FIG. 1.
Figure 2:
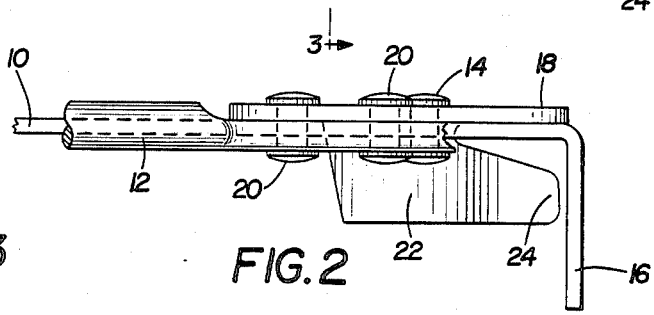
FIG. 2 is a fragmentary top plan view taken on the line 2—2 of FIG. 1.

Handle levers 10 and 12, as noted above, are pivoted with respect to one another, and such pivoting permits the operation of crown engaging member 16 and finger 22 with respect to each other. As seen in FIG. 4, when handle levers 10 and 12 are pivoted away from each other, crown engaging portion 16 and finger 22 are spread apart somewhat from each other. As handle levers 10 and 12 are pivoted toward one another, as seen in FIG. 1, outer finger tip 24 is moved to close proximity to crown engaging member 16.

In operation, the handles 10 and 12 are spread apart from each other to the position shown in FIG. 4. The outer tip 24 of finger 22 is inserted in the space between the lower edge of crimped flange 2 and the annular beads 4 and 5 of the neck of the bottle 3, and at the same time crown engaging portion 16 is placed upon the crown 1 of the cap. Handle members 10 and 12 are then pivoted toward one another which moves outer tip 24 of finger 22 upwardly and outwardly with respect to the top of the bottle. The movement of tip 24 upwardly toward crown engaging portion 16 causes crimped flange 2 of the bottle cap to be deflected outwardly away from annular ring 5 and breaks the seal between the bottle cap and annular ring 5. When handle levers 10 and 12 are pivoted toward each other to the position where the outward end of handle 10 engages the outer end of handle 12 (see FIG. 5), the bottle cap may be lifted away from the annular ring upon which it is sealed.

The outer extremity of finger tip 24, which is in close proximity to crown engaging member 16, clamps the removed cap and grips the cap after its removal so that the bottle cap may be disposed of handily and easily by the user of the bottle cap opener. The bottle cap may be removed from the jaws of the opener by pivoting handle levers 10 and 12 away from each other which will release the grip of the jaws on the bottle cap.

The bottle cap as removed by the combined action of flat crown engaging member 16 and curved finger 22 permits removal of the cap without substantially distorting the crown 1 of the bottle cap, except in the downturned flange 2 of the cap. Thus, a bottle cap that has been removed from a bottle may be replaced upon the bottle top to temporarily reclose the bottle so that any unused bottle contents may be stored for later usage. Resealing of the top of the bottle is possible because the top flat area 1 of the bottle cap has not been distorted to a degree which will prevent engagement of the inner bottle cap cork or plastic seal with annular ring 5.

An important aspect of the present invention involves the configuration of curved finger 22 which has a profile that is adapted to conform generally with the shape of the annular bead of the bottle with which the bottle opener will be used. Another important aspect of the invention involves the positioning of crown engaging member 16 which extends at substantially right angles from the axis of elongation of both handles 10 and 12. Additionally, the remote or outer end of handle 10 is flared outwardly slightly from the axis of elongation of the handle 10 to allow space for the fingers of the user of the opener when the device is applied to remove a bottle cap.

Figure 5:
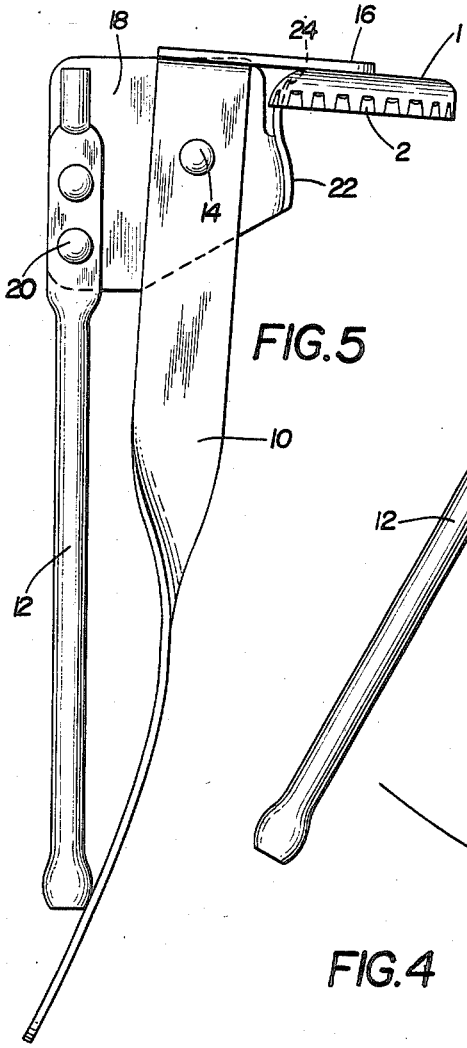
FIG. 5 is a side elevation showing the opener of the present invention retaining a cap after removal from a bottle top.

A further important aspect of the invention is the relative location of the finger tips 24 and crown engaging member 16 when the opener is in the FIG. 5 position. This permits the holding of a removed cap which is in reusable condition.

As seen in the drawings, handle 10 and crown engaging member 16 are formed of one piece of sheet metal. It is to be understood that handle 10 and crown engaging member 16 could be formed of two pieces of sheet metal suitably attached, as for example by rivets. Likewise, handle lever 12 and mounting plate 18 are illustrated as being formed of a two-piece construction fastened together by fastening means 20. It is to be understood that this construction could be readily formed of a single piece of sheet metal in which the handle lever 12 is an extension of mounting plate 18.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved bottle cap remover is constructed, assembled and operated, the characteristics of the new construction, and the advantageous, new and useful results obtained; the new and useful structures, devices, elements, arrangements, parts, and combinations are set forth in the appended claims.

I claim:

1. Bottle opener consruction for removing and retaining a crown seal cap having a crown including a flat top crown surface and a downturned crimped flange mounted on a bottle top having a cap engaging ring including a first elongated straight lever means having a jaw end and a hand engaging end, a second curved elongated lever means having a jaw end and hand engaging end, said first lever and second lever being pivotally attached to each other intermediate their respective jaw ends and handle ends, said levers being pivotal between open and closed positions, said first lever means including a flat bottle cap engaging member extending at right angles from said jaw end and adapted to engage the flat top crown surface of the crown sealed bottle cap, said second lever means including an elongated tapered finger portion adapted to be inserted between the downturned flange of the crown seal bottle cap and the annular ring of a bottle upon which the cap is sealed, said levers being constructed and arranged so that pivoting of a handle portion toward each other moves the finger portion of the second lever jaw toward the flat cap engaging member fo the first lever jaw to a position where said finger portion is adjacent said flat cap engaging member to effect removal of the bottle cap from the bottle without distorting the flat top crown surface of the bottle cap and to retain the removed bottle cap between the finger portion and the adjacent flat cap engaging member.

2. Bottle opener construction as defined in claim 1 in which said second lever jaw means finger portion is S-curved in shape and in which said S-curved portion terminates ina curved portion, curving outwardly and away from said first lever means.

* * * * *